US006409962B1

(12) United States Patent
Lawson

(10) Patent No.: US 6,409,962 B1
(45) Date of Patent: Jun. 25, 2002

(54) POWDER INJECTOR FOR LADLE

(75) Inventor: Paul D. Lawson, Moon Township, PA (US)

(73) Assignee: Rossborough Manufacturing Co., Avon Lake, OH (US)

( * ) Notice: Subject to any disclaimer, the term of this patent is extended or adjusted under 35 U.S.C. 154(b) by 0 days.

(21) Appl. No.: 09/678,292

(22) Filed: Oct. 2, 2000

(51) Int. Cl.[7] ..... C21C 7/00
(52) U.S. Cl. ..... 266/216; 266/226; 266/287
(58) Field of Search ..... 266/216, 225, 266/226, 217, 287

(56) References Cited

U.S. PATENT DOCUMENTS 3,486,745 A 12/1969 Fadler
4,004,919 A * 1/1977 Wilson ..... 75/53
4,326,701 A * 4/1982 Hayden, Jr. et al. ..... 266/225
5,211,744 A * 5/1993 Areaux et al. ..... 75/594

FOREIGN PATENT DOCUMENTS

JP 2001207209 * 7/2001

* cited by examiner

*Primary Examiner*—Scott Kastler
(74) *Attorney, Agent, or Firm*—Vickers, Daniels & Young

(57) ABSTRACT

A powder injector for a ladle of molten metal having an exposed upper level with a given shape. The injector comprises a splash deflector with a cast body of heat resistant material with a downwardly facing lower surface defining an outer periphery and maintained above the upper level of molten metal, an elongated powder injection lance with a tubular body extending vertically from above the deflector surface to a position substantially below the surface and into the molten metal and a directional outlet nozzle directed at a transverse angle to the lance body in a direction below the surface of the splash deflector and an upper member mounting the lance with respect to the splash deflector with the nozzle directed into the molten metal substantially below the lower surface and within the periphery of the lower surface.

14 Claims, 3 Drawing Sheets

POWDER INJECTOR FOR LADLE

The present invention relates to the alloying of molten metal and more particularly to the concept of a powder injector for small ladles of the type used in alloying molten metal.

INCORPORATION BY REFERENCE

The invention relates to ladles of the type used in foundries or ferro alloying plants, such as generally illustrated in Fadler U.S. Pat. No. 3,486,745. In the past, molten metal is alloy in relatively small ladles, such as a ladle having a capacity of less than about 10 tons. These ladles are heated by external sources, such as electrical induction or gas heating, and, to prevent splashing, a removable lid or cover is employed. Such ladle is illustrated in Fadler U.S. Pat. No. 3,486,745 that is incorporated by reference as background information.

BACKGROUND OF INVENTION

Production of alloys such as ferro silicon magnesium involves the melting of ferro silicon in a relatively small ladle. To introduce the desired amount of magnesium, a large bar or ingot of manganese is lowered into the molten metal, resulting in a substantial amount of magnesium being lost as vapor. Further, the surface area of the large magnesium bar does not facilitate rapid melting and dispersion of the magnesium in the molten ferro silicon. Magnesium powder is substantially cheaper than a magnesium ingot or bar and provides larger surface area for rapid melting of the magnesium and dispersion into the ferro silicon. However, efforts to inject powder into the small ladle results in violent splashing of the molten ferro silicon. The need for a gaseous carrier to inject powder into the molten metal further exacerbates the splashing and violent reaction at the surface of the hot ferro silicon. Consequently, the more expensive magnesium bar or ingot is used in a ferro silicon plant to alloy ferro silicon with magnesium. The same problem is experienced in other metallurgical processes in foundries that experience splashing and violent surface agitation in small ladles caused by alloying powder, including magnesium, calcium oxide, or calcium carbonate, to name only a few. Such foundry ladles normally have covers that are either on or off as shown in Fadler U.S. Pat. No. 3,486,745. To inject powder, the cover is removed and the powder lance is moved into the molten metal causing the aforementioned unacceptable splashing and violent surface agitation of the metal in the ladle.

THE INVENTION

The present invention relates to a powder injector for a small ladle of molten metal having an exposed upper surface. This powder injector allows powder carried by a gaseous media, preferably nitrogen, through a lance to be injected under the surface of the molten metal, without the problems experienced by splashing and spraying of molten metal from the ladle during the powder injection process. This new powder injector comprises a splash deflector with a cast body of heat resistant material. A downwardly facing lower surface of the body defining an outer periphery is suspended over the upper level of molten metal, whereby the downwardly facing surface is just above the molten metal. The outer periphery of the splashing deflector cast body has a notch to accommodate an elongated powder injection lance with a tubular body extending vertically from above the deflector surface to a position substantially below the molten metal surface and into the molten metal. This lance includes a directional outlet nozzle for directing the powder in a path at a transverse angle to the lance body. The powder and gaseous carrier is maintained below the large lower surface of the deflector body. By suspending both the lance and the splash deflector from a common mechanism, the powder injector can be lowered into the ladle. The periphery may be contoured to match this one side in one embodiment; however, this is not a requirement. The injector can be positioned away from the side or adjacent an opposite side. The downward movement of the deflector and lance is stopped when the surface of the cast body is slightly above the molten metal surface and the lance is below the surface. The lance nozzle directs powder and the gaseous carrier in a path generally bisecting the deflector lower surface, whereby all agitation of the molten metal occurs below the surface of the deflector.

In accordance with an aspect of the invention, the size of the upper surface of metal in the ladle is substantially greater than the peripheral size of the splash deflector. In this manner, the splash deflector and associated lance is suspended above and adjacent to one side of the ladle. Other surface areas of molten metal in the ladle are exposed; however, they are not agitated because the injection of powder occurs below the splash deflector. The lance can be associated with the deflector outside of the body periphery so long as the directional nozzle propels injected powder underneath the deflector. In accordance with the preferred embodiment, a notch is provided in the body of the splash deflector at a position opposite to the position of the ladle side wall matching the deflector. Thus, the injector propels powder toward the covered side of the ladle and under the splash deflector to prevent surface agitation and unwanted splashing of metal from the ladle. Molten metal in the remainder of the ladle is quiescent and can be charged with other alloying agents that do not have the volatile nature of powdered magnesium.

In accordance with another aspect of the invention, the splash deflector, with an internal metal framework, is a separate component from the injector lance. Thus, the lance can be changed before the splash deflector and lance are moved downwardly in unison into the molten metal. A notch in the deflector receives the lance or the lance can be adjacent the periphery of the deflector body. In both instances, the propelled path of the powder is under the deflector.

In accordance with another aspect of the present invention, there is provided a method of injecting powder into a molten metal in a ladle, wherein the molten metal has an upper level with an exposed large shape. Powder is injected into the molten metal by a lance having a position below the upper surface of the metal and injected under the deflector. The powder injection path is covered by placing the splash deflector over the upper level of metal. A lower large surface is above the powder injection path. Consequently, the injected powder and gas carrier cause violent reaction in the body of the molten metal below the surface of the splash deflector and near the injector. The remainder of the molten metal remains quiescent and can be charged with other constituents, if desired. There is no need to remove the splash deflector for injecting of powder into the molten metal.

The primary object of the present invention is the provision of a powder injector for foundry and metallurgical plants using small ladles, which injector allows injection of powder carried in a gas even though such injected constituents cause violent surface reaction of the molten metal.

Yet another object of the present invention is the provision of a powder injector, as defined above, which powder injector includes a large splash deflector, with the powder injected into the molten metal below the splash deflector. The violent reaction is under the deflector.

Still a further object of the present invention is the provision of a method of injecting powder into a molten metal, which method prevents unwanted splashing and loss of the powdered material.

These and other objects and advantages will become apparent from the following description taken together with the accompanying drawings.

PREFERRED EMBODIMENT

Figure 1:
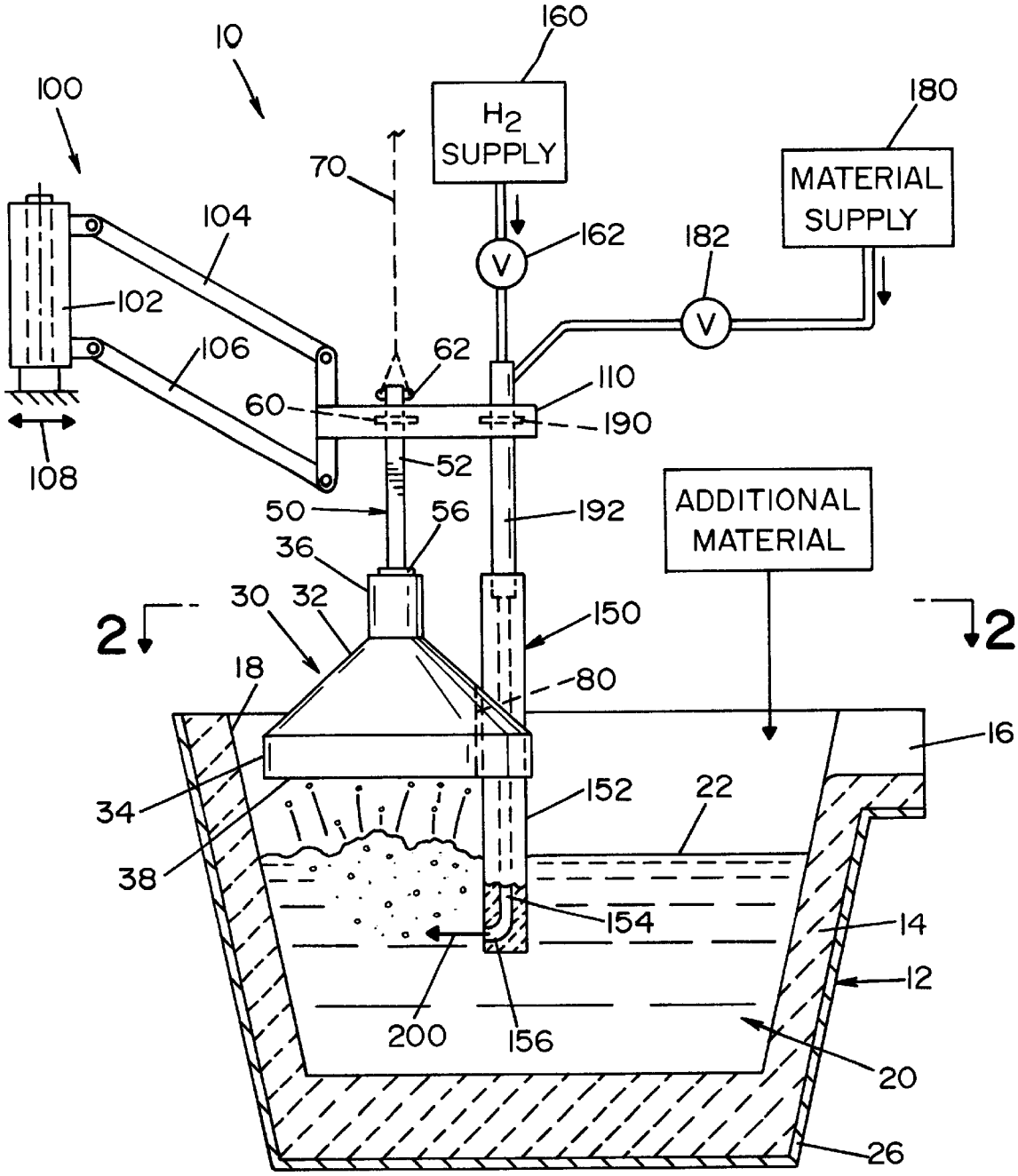
FIG. 1 is a side elevational view showing, somewhat schematically, the preferred embodiment of the present invention with a foundry ladle shown in cross-section.
Figure 2:
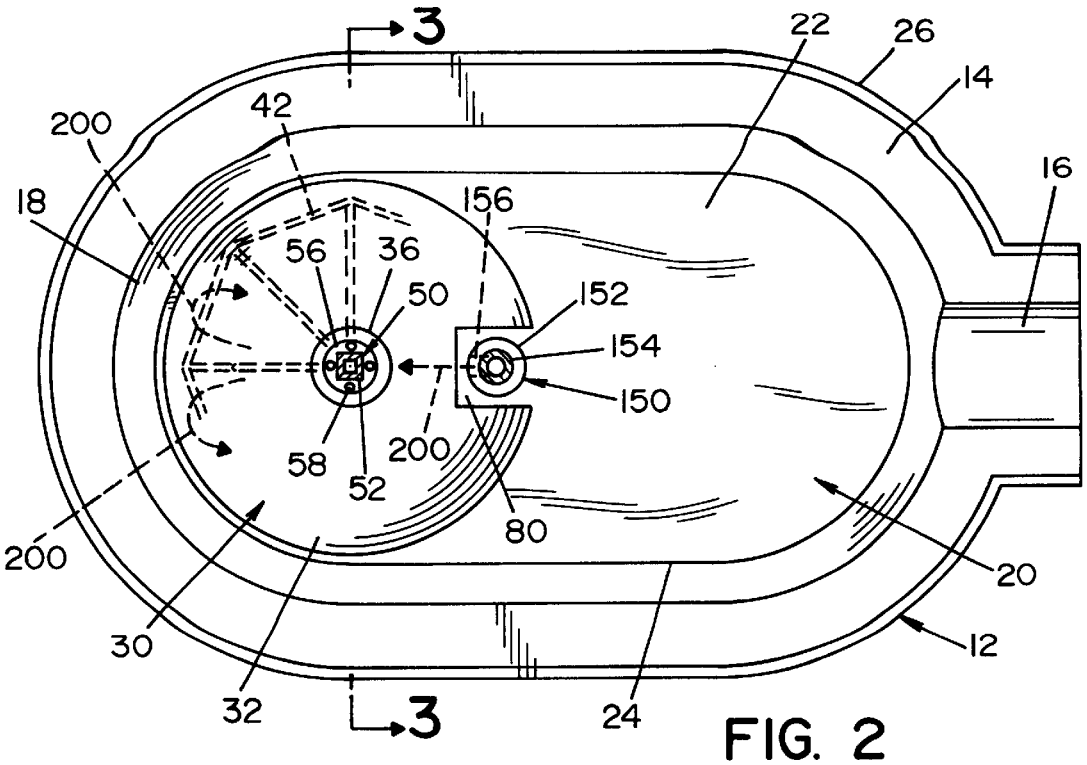
FIG. 2 is a top elevational view taken generally along line 2—2 of FIG. 1.
Figure 3:
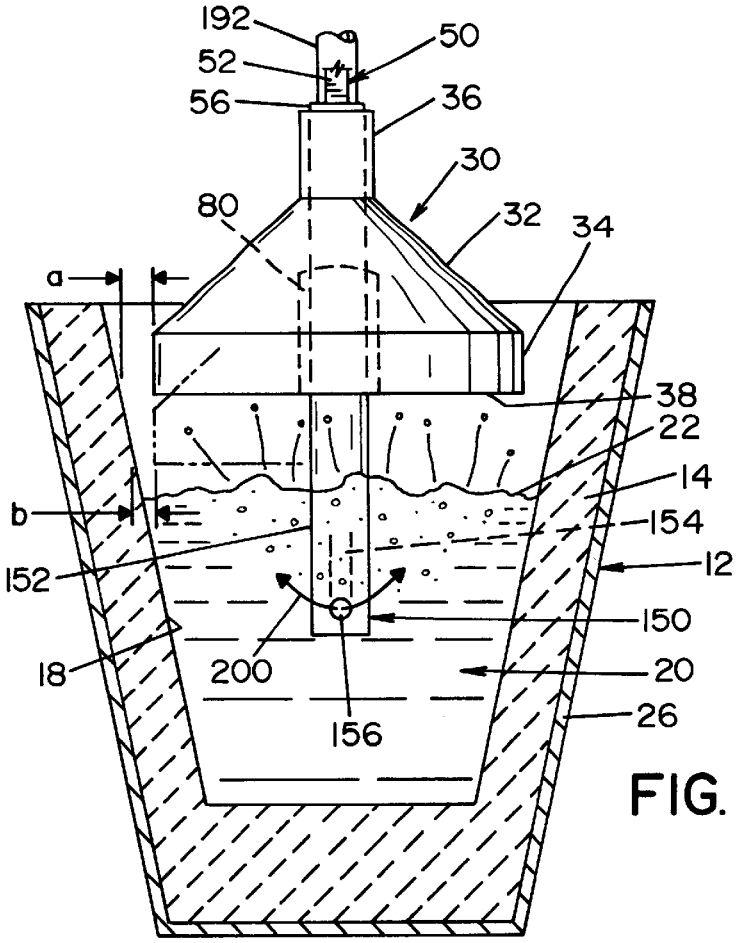
FIG. 3 is a cross-section view taken generally along line 3—3 of FIG. 1, with the splash deflector shown in solid lines; and, FIG. 4 is an enlarged, cross-sectional view showing the preferred embodiment of the splash deflector.

Referring now to the drawings, wherein the showings are for the purpose of illustrating the preferred embodiment of the invention only and not for the purpose of limiting same, FIGS. 1–3 show a powder injector 10 for injecting powder, such as magnesium, into a ladle 12 of a foundry or ferro alloy plant. Ladle 12 has a ceramic or refractory liner 14, a pouring spout 16 and one side area 18 at the left of the ladle as shown in FIGS. 1 and 2. Molten metal 20 in the preferred embodiment is ferro silicon and has an upper level 22 with an oblong shape 24, as shown in FIG. 2. Outer support casing 16 holds ladle 12 in position with respect to an appropriate heating mechanism (not shown) to heat or maintain the molten condition of metal 20. Power injector 10 includes splash deflector 30 having a cast heat resistant body 32 in the form of an inverted cone with a cylindrical skirt 34 and an upper cylindrical neck 36. Body 32 is cast from a heat resistant ceramic material to define lower, downwardly facing surface 38. Such surface may have a slight curvature. The outer periphery defined by skirt 34 is circular with an area substantially less than the area of shape 24. Splash deflector 36 is shown suspended in a position adjacent wall 18 at one end of ladle 12, but it can be moved to the right. Such position is preferred. The outer periphery of surface 38 generally matches the walls of ladle 12 to define spacing a, best shown in FIG. 3. As deflector 30 is moved downwardly toward level 22, a close spacing is created. Spacing a for deflector 30 in solid lines is decreased to spacing b for the phantom line position of the deflector. It is contemplated that irrespective of the amount of metal in ladle 12 there remains some spacing around skirt 34. In practice, the shape of skirt 34 generally matches one end of ladle 12. However, a powder deflector 10 can be located at various positions in the ladle and in ladles having a variety of wall shapes. The matching of the circular shape with the curved wall at one end of the ladle is preferred.

Figure 4:
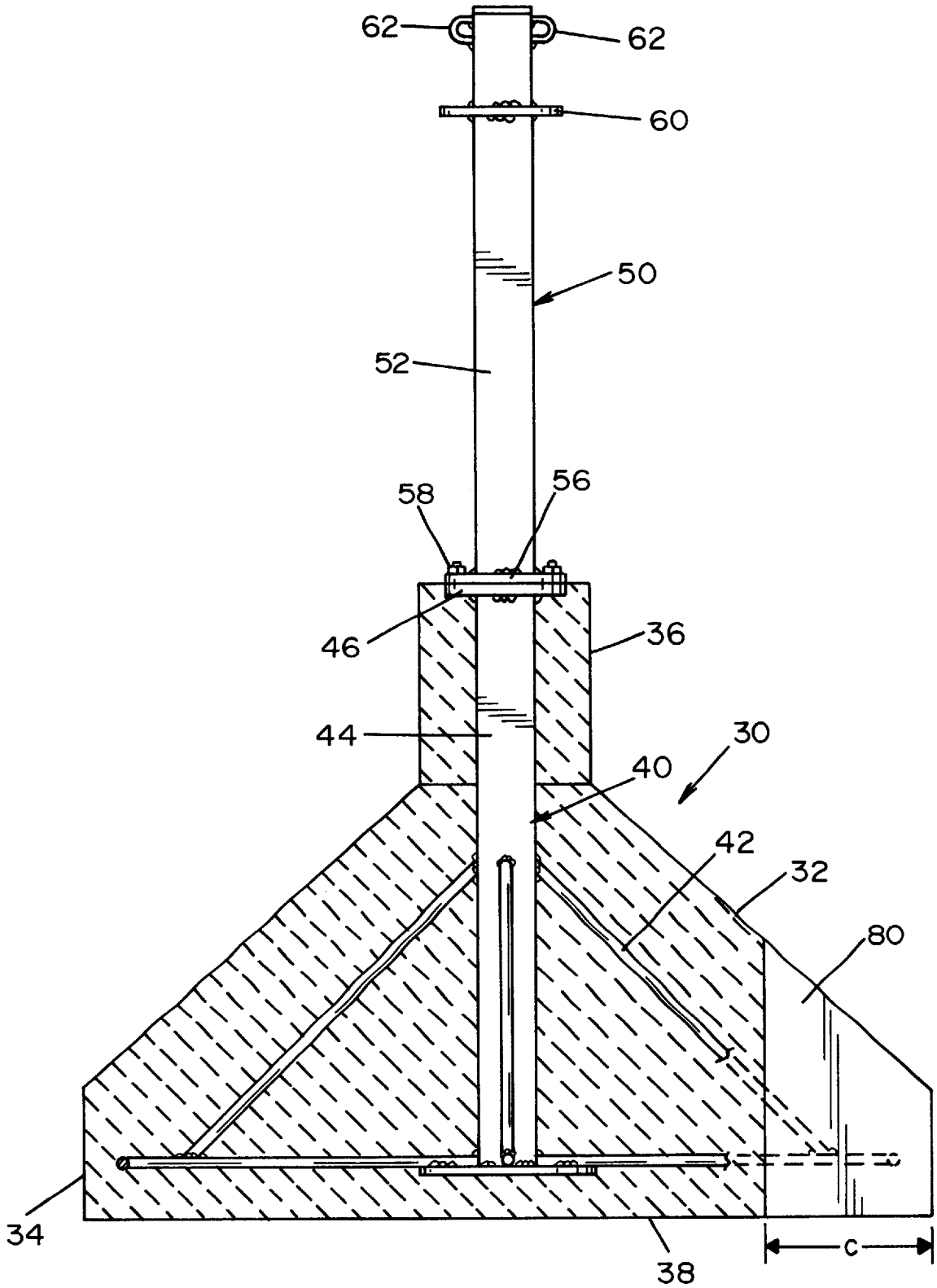

Body 30 is cast and has a limited structural integrity; therefore, a reenforcing and suspension member 40 is provided. This member includes a generally conical steel framework 42 with a central lift bar 44. These elements are welded together, as indicated in FIG. 4, with a circular plate 46 on the top of bar 44. To move body 30 vertically with respect to the molten metal, hanger 50 includes a vertical bar 52 with a bottom plate 56 bolted to the top plate 46 by a series of bolts 58. These bolts can be removed to attach a new splash deflector 30 onto hanger 50. Collar 60 is used for hanging deflector 30 which can be moved vertically by chain loops 62 by chain 70, shown in a dashed line in FIG. 1. The chain is connected to a crane to pick up deflector 30 for assembly to the pantograph for movement into the proper position above the metal in the ladle. A notch 80, with a depth c as shown in FIG. 4, is provided at the right side of deflector 30 for accommodating the powder lance to be described later.

Pantograph 100 is generally standard equipment in a foundry and is schematically illustrated as a support stand 102 with outboard movable arms 104, 106. Stand 102 can move in all directions as indicated by arrows 108. Consequently, support bracket 110 is moved to different positions over ladle 12 and supports collar 60 by a standard releasable latch (not shown). Splash deflector 30 is, thus, moved to the proper position over the ladle and is then lowered vertically to position surface 38 just above the upper level 22 of molten metal. Injection lance 150 has a ceramic covered body portion 152 and fits into notch 80 of body 30, as shown in FIGS. 1–3. Internal passage 154 terminates in a lower directional nozzle 156 below level 22. A carrier gas supply 160 has a gas flow controlled by valve 162. The carrier gas captures powdered magnesium or other material in supply 180 having a powder discharge rate controlled by valve 182. Gas supply 160 and material supply 180 are mounted on pantograph 100. The lance is mounted on bracket 110 by collar 190 on tube 192. Gas from valve 162 entraps powder from valve 182 and carries the powder through passage 154. Thereafter, the gas propels powder out nozzle 156 in injection path 200, best shown in FIG. 1. This path is generally centered below surface 38 whereby agitation as shown in FIGS. 1 and 3 occurs below deflector 30. Path 20 does not go beyond the deflector. The magnesium vaporizes at once. Deflector 30 is shown adjacent one contoured wall of the ladle. But, the deflector can be in the middle with injection path 200 extending under the deflector 30 to prevent splashing. The invention is broad enough to merely be the large surface deflector with a powder lance at one side blowing powder in the molten metal across, but below, the periphery of the splash deflector. The deflector is often positioned to the right of the position, shown in FIGS. 1 and 2.

By using the powder injector 10 with bracket 110 maintaining the position of the deflector and lance, these two components can be moved together by pantograph 100. Collar 190 and collar 60 are captured on bracket 110 for movement in unison. The arrangement for holding the two components and moving the two components does not form a part of the invention since a variety of mechanical structures can be used and are, indeed, employed for this purpose. In a majority of instances, the standard pantograph available in a boundary for moving implements above the ladles is the preferred mechanics of moving the two components together by bracket 110. Lance 150 can be changed whenever the material is different, or it becomes worn or otherwise defective.

Having thus defined the invention, the following is claimed:

1. A powder injector for use with a ladle of molten metal having an exposed upper surface, said injector comprising a splash deflector with a cast body of heat resistant material having a downwardly facing lower surface with an outer periphery, an elongated powder injection lance having a tubular body extending vertically adjacent said outer periphery from above said deflector to a position substantially below said upper surface, said lance having an outlet nozzle directed at a transverse angle to said tubular body in a direction inwardly of said outer periphery and below said lower surface of said splash deflector, and means for mounting said lance and said splash deflector in relation to said ladle.

2. A powder injector as defined in claim 1, wherein said ladle includes a peripheral wall having spaced apart end walls, at least one of which is semicircular and has a radius of curvature, said outer periphery of said splash deflector being circular and located adjacent said one end wall.

3. A powder injector as defined in claim 2, wherein said outer periphery has a radius of curvature that is less than said radius of curvature of said one end wall.

4. A powder injector as defined in claim 3, wherein said cast body is one of a ceramic and refractory material formed around a metal framework.

5. A powder injector as defined in claim 4, wherein said cast deflector is in the shape of an inverted cone with a circular skirt and a circular neck.

6. A powder injector as defined in claim 5, wherein said cast body includes a transverse notch and said lance extends vertically through said notch.

7. A powder injector as defined in claim 1, wherein said outer periphery of said splash deflector is circular.

8. A splash deflector for use with a lance that injects powdered material into a ladle of molten metal having an exposed upper surface, said deflector having a body of cast heat resistant material formed around a metal framework and having a downwardly facing lower surface with an outer periphery, means for suspending said body over a ladle, said body being in the shape of an inverted cone with a circular skirt and a circular neck.

9. A splash deflector as defined in claim 8, wherein said cast body is one of a ceramic and refractory material formed around a metal framework.

10. A splash deflector as defined in claim 9, wherein said outer periphery is circular.

11. A splash deflector as defined in claim 10, wherein said cast body includes a transverse notch to accommodate a lance.

12. A method of injecting powder into a ladle of molten metal having spaced apart end walls, comprising the steps of:

a) providing injection means for injecting a stream of powder into said molten metal, b) providing deflecting means for deflecting splashing of said molten metal, said deflecting means having an outer periphery, c) positioning said deflecting means between said end walls of said ladle and above said molten metal, d) positioning said injection means adjacent the periphery of said deflection means, e) lowering said injection means into said molten metal, f) directing a stream of powder from said injection means laterally inwardly of said deflecting means whereby all agitation and splashing occurs under said deflecting means.

13. A method as defined in claim 12, and positioning said deflecting means adjacent one of said end walls such that a close spacing is created therebetween.

14. A method as defined in claim 13, including positioning said injection means adjacent said periphery for said stream to be directed toward said one end wall.

* * * * *